US008335449B2

(12) United States Patent
Sakai et al.

(10) Patent No.: US 8,335,449 B2
(45) Date of Patent: Dec. 18, 2012

(54) IMAGE FORMING APPARATUS

(75) Inventors: Katsuhide Sakai, Toyokawa (JP); Hiromichi Toda, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 673 days.

(21) Appl. No.: 12/486,581

(22) Filed: Jun. 17, 2009

(65) Prior Publication Data

US 2009/0317118 A1 Dec. 24, 2009

(30) Foreign Application Priority Data

Jun. 19, 2008 (JP) ..... 2008-159904

(51) Int. Cl.
*G03G 21/00* (2006.01)

(52) U.S. Cl. ..... 399/75

(58) Field of Classification Search ..... 399/38, 399/43, 44, 46, 75, 76, 77, 83, 88, 167
See application file for complete search history.

(56) References Cited

U.S. PATENT DOCUMENTS

2008/0085130 A1* 4/2008 Yamaguchi ..... 399/44
2009/0297172 A1* 12/2009 Kaji ..... 399/13

FOREIGN PATENT DOCUMENTS

JP 7-196208 8/1995
JP 11-194678 7/1999
JP 2000-289883 10/2000
JP 2004-291243 10/2004
JP 2006-47350 2/2006
JP 2006-142779 6/2006
JP 2006-293233 10/2006
JP 2008-90143 4/2008

OTHER PUBLICATIONS

Translation of Tomioka (JP2006142779A, listed in IDS, pub date: Jun. 8, 2006).*
Translation of Shibata (JP2006047350A, listed in IDS, pub date: Feb. 16, 2006).*
Japanese Notification of Reasons for Refusal mailed May 11, 2010, directed to corresponding Patent Application No. 2008-159904; 8 pages.

* cited by examiner

*Primary Examiner* — Walter L Lindsay, Jr.
*Assistant Examiner* — Frederick Wenderoth
(74) *Attorney, Agent, or Firm* — Morrison & Foerster LLP

(57) ABSTRACT

A color printer of the invention is controlled to select DC motors needed to be newly activated according to a print mode when a print job occurs, determine an activation start time of each selected DC motor by sequentially going back activation times stored in relation to the selected DC motors from an image start reference time, activate one or ones of the DC motors to be activated according to the determined activation start times, measure an actual activation time of the activated DC motor and update a stored content about the activation time based on a measurement result of the actual activation time, and determine an activation start time of each DC motor based on the updated activation time. An image forming apparatus capable of preventing the motors from rotating more than necessary and effectively utilizing the life of components to be driven by the motors can be provided.

19 Claims, 9 Drawing Sheets

IMAGE FORMING APPARATUS

This application is based upon and claims the benefit of priority from the prior Japanese Patent Application No. 2008-159904 filed on Jun. 19, 2008, the entire contents of which are incorporated herein by reference.

TECHNICAL FIELD

The present invention relates to an image forming apparatus having a DC motor and, more particularly, to an image forming apparatus having a plurality of DC motors whereby corresponding load devices are respectively driven to rotate.

BACKGROUND ART

Image forming apparatuses each have a plurality of rotary bodies such as a photoconductor and developing roller. Most of the apparatuses also include a plurality of motors for rotating the rotation bodies respectively. For instance, during activation by power-on, some of inactive motors need to be activated individually and controlled to rotate at respective required rotation speeds. However, during motor activation, a larger amount of electric current generally has to be supplied as compared with an electric current needed under fixed speed control. To activate the plurality of motors at the same time, the apparatus needs to include a relatively high-capacity power supply.

To avoid the need for the high-capacity power supply, conventionally, for start-up of a plurality of motors, they would be activated in order at different timings. A first motor is first activated and, after a lapse of a predetermined activation time from the activation start thereof, a second motor is activated. After a lapse of an activation time of the second motor, furthermore, the first and second motors are judged to be in a controllable state. As this activation time, for example, a maximum time required for activation of the relevant motor is set.

This case however may cause a disadvantage that a wait time is long from power-on until image formation becomes ready to start. On the other hand, there is disclosed an image forming apparatus in which the activation timing of a motor of which the start-up characteristic is stable during activation, such as a pulse motor, is set without any time interval from the activation timings of other motors (e.g., see Patent Literature 1).

CITATION LIST

Patent Literature

Patent Literature 1: JP2000-289883A

SUMMARY OF INVENTION

Technical Problem

However, even in the above conventional image forming apparatus, if a plurality of brushless motors is to be activated, respective activation timings have to be set with time intervals therebetween. The time intervals are determined in advance based on the activation time of the motor needing a longest time required to stabilize electric current supplied thereto after start of motor activation. A motor having a short activation time is likely to be rotated more than necessary. Even for the motor having the longest activation time, the electric current supplied to that motor may be stabilized in a shorter time depending on conditions. In this case, that motor is also rotated more than necessary.

When the motor is rotated, a load member to be driven by the motor is also rotated. Some of load members used in the image forming apparatus have the length of component life determined according to the cumulated number of rotations. If such member is rotated more than necessary, it will sooner reach the end of its component life by just that much. In other words, since activation timings are set with time intervals to avoid the need for the high-capacity power supply, a disadvantage is caused that the component life is likely to be shortened.

The present invention has been made to solve the problems of the aforementioned conventional image forming apparatus and has a purpose to provide an image forming apparatus capable of preventing motors from rotating more than necessary and hence effectively utilize the life of components to be driven by the motors.

Solution to Problem

According to one aspect of the invention, there is provided an image forming apparatus comprising: an image forming section including a plurality of rotary bodies to form an image by rotation of the rotary bodies; a plurality of DC motors for driving each part of the image forming section; and a drive control section for controlling the DC motors, each of the DC motors being adapted to drive at least one of the rotary bodies, wherein the apparatus comprises: an activation time storage section for storing an activation time required for each of the DC motors to reach a target speed from activation start thereof; a rotation storage section for storing ones of the DC motors, the ones being needed to be rotated in each print mode; a preparation time storage section for storing a preparation time required for a part of the image forming section excepting the DC motors to become ready to start image formation in each print mode; a reference time determining section for determining, when a print job occurs, an image start reference time based on the preparation time stored in the preparation time storage section according to a print mode of the print job, an activation control section for: when a print job occurs, selecting one or ones of the DC motors, the one or ones being needed to be newly activated, according to a print mode of the print job based on a current rotating status of each of the DC motors and a stored content of the rotation storage section; determining an activation start time of each of the selected DC motors by sequentially going back, from the image start reference time, activation times of the selected DC motors stored in the activation time storage section; and; activating one or ones of the selected DC motors to be activated, at each determined activation start time; an actual activation time measuring section for measuring an actual activation time of each of the DC motors to be activated by the activation control section; and an activation time updating section for updating the stored content of the activation time storage section based on a measurement result of the actual activation time measuring section, the activation control section being adapted to determine an activation start time of each of the DC motors based on the activation time updated by the activation time updating section for a next print job.

According to the above image forming apparatus, when a print job occurs, the image start reference time is determined based on the preparation time of parts or components other than the DC motors, and the activation start time of each DC motor is determined by sequentially going back the activation times of the motors from the image start reference time.

Accordingly, when preparation of the parts or components other than the DC motors is finished, all the DC motors needed to be activated have reached a target speed. Furthermore, the activation time of each DC motor is updated based on an actually measured activation time and is used for a next print job. That is, an appropriate activation time is set in each motor instead of assigning a maximum time to all the motors. This makes it possible to prevent the motors from rotating more than necessary and thereby effectively utilize the life of each component to be driven by the motors.

Advantageous Effects of Invention

The image forming apparatus of the invention can prevent unnecessary rotation of motors and hence maximize the life of components to be driven by the motors.

DESCRIPTION OF EMBODIMENTS

Embodiment 1

A detailed description of a preferred embodiment of an electrophotographic image forming apparatus embodying the present invention will now be given referring to the accompanying drawings.

Figure 1:
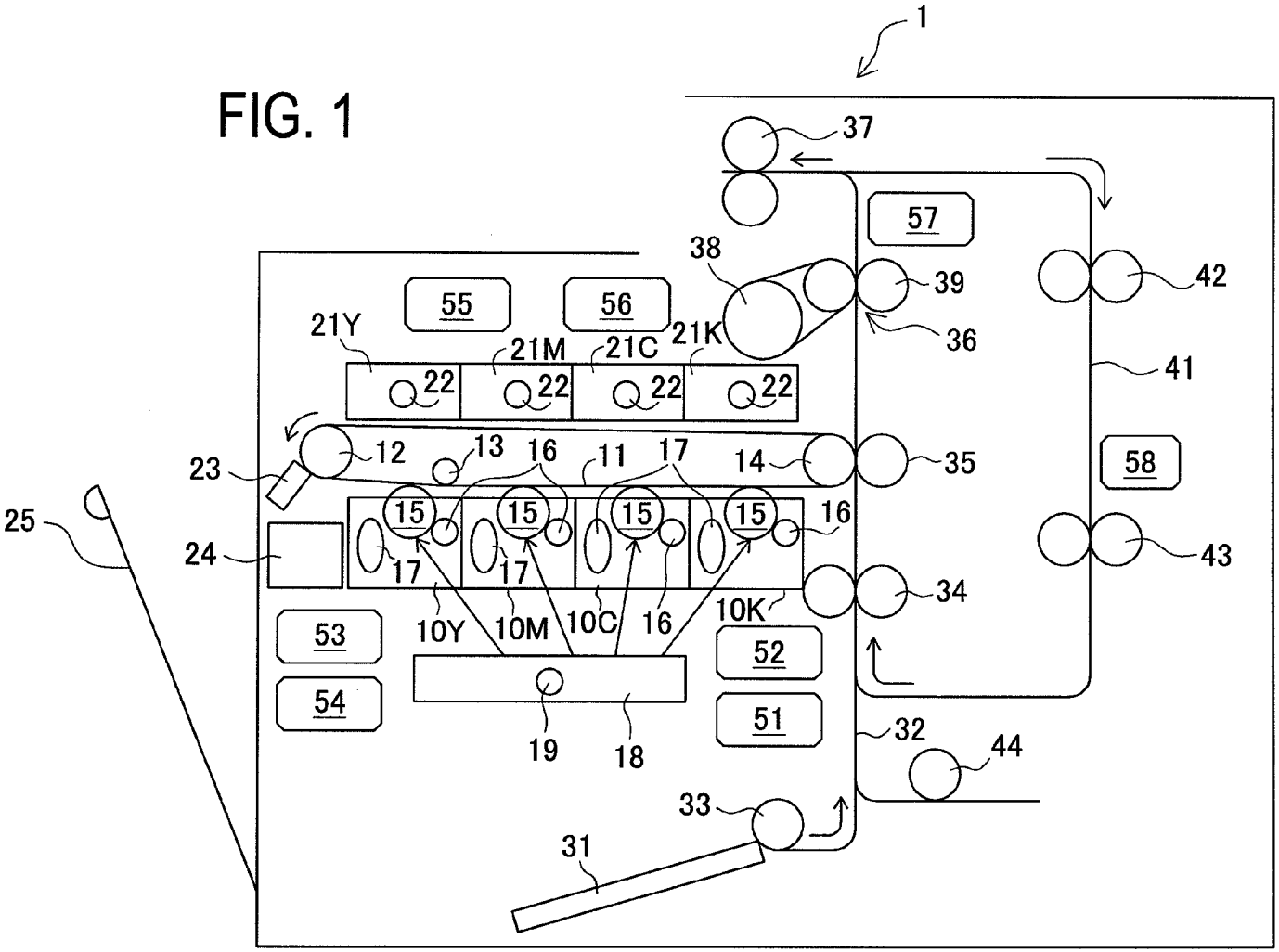
FIG. 1 is a schematic configuration view of a color printer of a preferred embodiment.

FIG. 1 shows a schematic configuration of a color printer 1 of this embodiment. This is a so-called tandem printer in which various color image cartridges 10Y, 10M, 10C, and 10K are arranged along an intermediate transfer belt 11. The intermediate transfer belt 11 is wound over three rollers 12, 13, and 14 and driven by them to rotate. Each of the image cartridges 10Y, 10M, 10C, and 10K includes a photoconductor 15, a charger 16, and a developer 17. Under the image cartridges 10Y, 10M, 10C, and 10K, an exposure 18 is disposed in which a polygon mirror 19 is placed.

Above the intermediate transfer belt 11 in FIG. 1, toner bottles 21Y, 21M, 21C, and 21K each containing each color toner are arranged. In each of the toner bottles 21Y, 21M, 21C, and 21K, an agitating blade 22 is provided to agitate the toner contained therein. A belt cleaner 23 is located in contact with a left side of the intermediate transfer belt 11 in the figure and a waste toner box 24 is placed under the belt cleaner 23 in the figure. Furthermore, an openable door 25 is provided in the front of the color printer 1.

In a lowermost area in this color printer 1 in FIG. 1, a sheet cassette 21 is placed for containing sheets to be used for image formation. The sheets contained in this sheet cassette 31 will be fed along a sheet feed path 32 formed on the right in the figure. Along the sheet feed path 32, there are arranged a sheet feeding roller 33, a timing roller 34, a secondary transfer roller 35, and a fuser unit 36 to feed a sheet from top down in the figure. In an uppermost area in FIG. 1, a sheet discharging roller 37 is placed to discharge a sheet formed with an image to the outside of the printer 1. The fuser unit 36 has a heating roller 38 and a pressure roller 39.

The color printer 1 of this embodiment can perform double-side printing and includes a sheet feed path 41 for the double-side printing. Along the sheet feed path 41, there are arranged a first feeding roller 42 and a second feeding roller 43. The color printer also has a manual sheet feeding roller 44 for manual sheet feeding.

Furthermore, the color printer 1 of this embodiment includes various motors 51 to 58. A main motor 51 is used to drive and rotate the photoconductor 15 of the image cartridge 10K for black color, the sheet feeding roller 33, a roller for driving the intermediate transfer belt 11, and others. A developing motor 52 is used to drive and rotate a developing roller contained in the developer 17 of the black image cartridge 10K and others. A color PC motor 53 is used to drive and rotate a photoconductor 15 and others in each of the image cartridges 10Y, 10M, and 10C for other colors than black. A color developing motor 54 is used to drive and rotate a developing roller and others contained in the developer 17 of each of the image cartridges 10Y, 10M, and 10C for other colors than black.

Toner replenishment motors 55 and 56 are used to replenish black and other color toners to respective corresponding developers 17 and also drive and rotate the agitating blade 22 in each toner bottle. The color toner contained in each of the toner bottles 21Y, 21M, 21C, and 21K is supplied to the corresponding developer 17 by rotation of a feeding member such as an auger or a screw. In this embodiment, the toner replenishment motor 55 for yellow and magenta colors and the toner replenishment motor 56 for cyan and black colors are provided. A fuser motor 57 is used to drive and rotate the pressure roller 39 of the fuser unit 36. The double-side printing motor 58 is used to drive and rotate the first feeding roller 42 and the second feeding roller 43. In this embodiment, the motors 51 to 58 are all DC brushless motors.

Image forming operations to be performed by the color printer 1 of this embodiment will be briefly explained below. For forming monochromatic images in black, the photoconductor 15 for black and the intermediate transfer belt 11 are rotated by the main motor 51 while the developing roller for black is rotated by the developing motor 52. In addition, each roller of a sheet feeding system (the sheet feeding roller 33, the timing roller 34, the sheet discharging roller 37, etc.) is rotated by the main motor 51.

On the photoconductor 15 uniformly charged by the charger 16, an electrostatic latent image is formed based on image data by the exposure 18. This electrostatic latent image is developed by the developer 17 and then a toner image is formed on the photoconductor 15. This toner image is transferred once the intermediate transfer belt 11 and then transferred onto a sheet at a secondary transfer station. The sheet is fed along the sheet feeding path 32 to the secondary transfer station by rotation of the sheet feeding roller 33 and the timing roller 34. The toner image transferred on the sheet is fused on the sheet by the fuser unit 36. Furthermore, the sheet having passed the fuser unit 36 is discharged out by the discharging roller 37.

If color printing is commanded, on the other hand, the color PC motor 53 and the color developing motor 54 are driven in addition to the main motor 51 and the developing motor 52. Those motors cause the photoconductors 15 for three colors other than black and the developing rollers for the three colors to rotate. If double-side printing is commanded, the double-side printing motor 58 is driven in addition to the above motors. For performing the double-side printing, the sheet one side of which has been printed is moved back along the sheet feeding path 41 for double-side printing and then the other side is printed in the same steps.

When it is determined that the toners are consumed in the developers 17 to a certain level needing replenishment, the toner replenishment motors 55 and 56 are driven to replenish toner from the toner bottles 21Y, 21M, 21C, and 21K into the corresponding developers 17. Furthermore, the toner in each toner bottle is appropriately agitated by each agitating blade 22.

Figure 2:
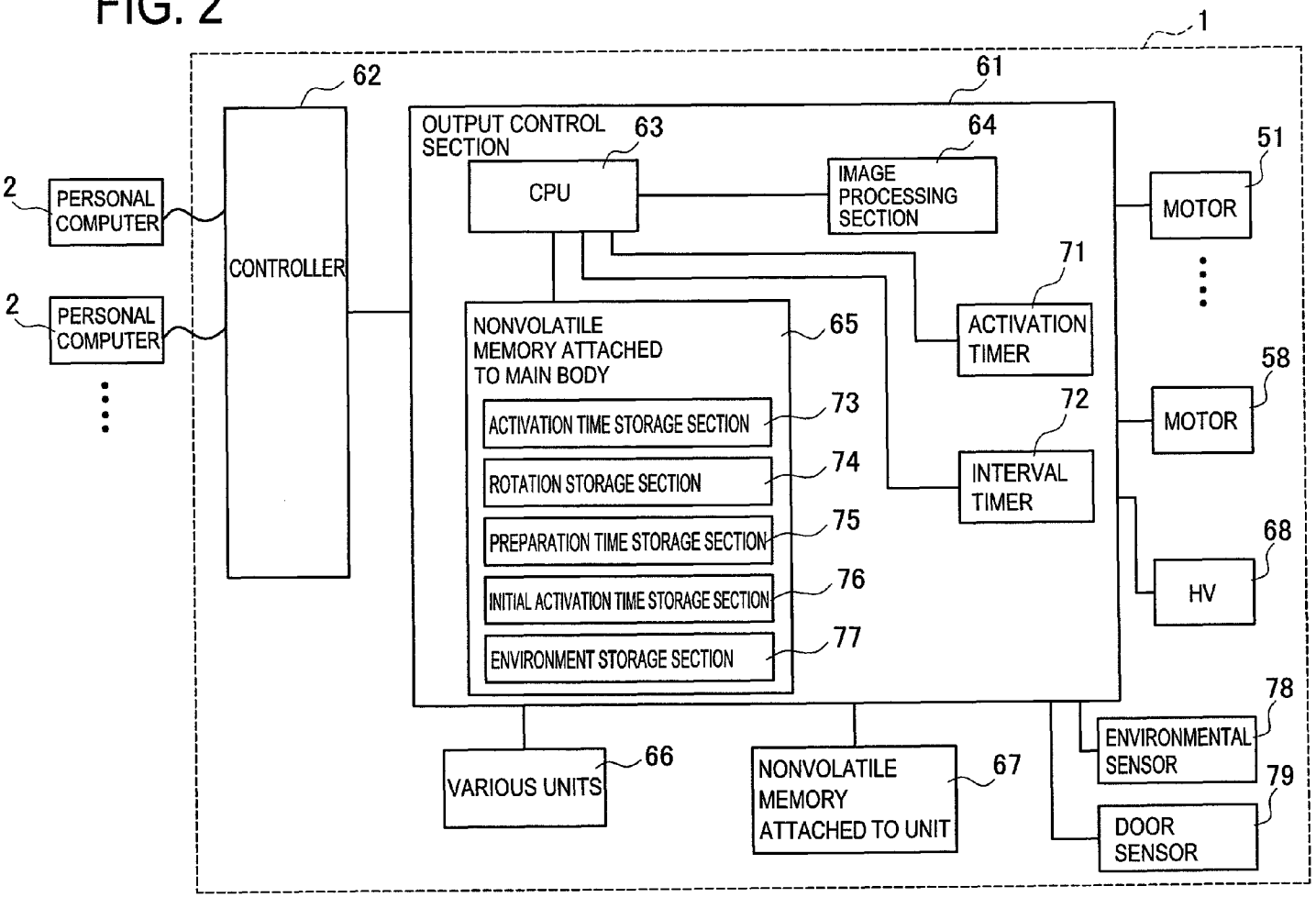
FIG. 2 is a block diagram schematically showing a control configuration of the color printer of the embodiment.

Next, FIG. 2 schematically shows a control configuration of the color printer 1 of this embodiment. This color printer 1 includes an output control section 61 and a controller 62 in order to control each part or unit. The output control section 61 has a CPU 63 for controlling the entire printer 1, an image processing section 64 for processing image data, and a non-volatile memory 65.

The output control section 61 further controls various units 66 contained in the color printer 1. The various units 66 include for example a user-replaceable member such as a toner bottle and an imaging unit. A nonvolatile memory 67 attached to each unit 66 stores a usage status and others of the unit. For instance, a memory attached to the toner bottle stores a toner remaining amount and others and a memory attached to the imaging unit stores the number of printed sheets and others. The output control section 61 conducts writing and reading of these nonvolatile memories 67. Instead of the nonvolatile memory 67, an IC chip or the like adapted for purposes may be used.

The color printer 1 of this embodiment further includes a high-voltage power supply (HV) 68 which is used for power supply for e.g. application of bias voltage and electric current to each part or unit such as each photoconductor 15, each developer 17, and a transfer system, during image formation. During activation of this HV 68, it takes a little time to stabilize output. In this embodiment, accordingly, the HV 68 is activated after completion of activation of the motors.

The output control section 61 further includes an activation timer 71 and an interval timer 72. The activation timer 71 is used to measure the time actually taken to activate each of various motors and others. The interval timer 72 is used to measure an elapsed time from a preceding drive termination. For example, the timers 71 and 72 may each include a plurality of timers individually used for the motors. The activation timer 71 corresponds to an actual activation time measuring section and the interval timer 72 corresponds to a print interval measuring section, respectively.

The nonvolatile memory 65 attached to a main body of the color printer 1 is provided with various storage sections, namely, an activation time storage section 73, a rotation storage section 74, a preparation time storage section 75, an initial activation time storage section 76, and an environment storage section 77. The activation time storage section 73 stores estimated activation times. An estimated activation time is an estimated time length required for activating each motor and the HV 68. The rotation storage section 74 stores a list of motors needed to be rotated according to job modes. The preparation time storage section 75 stores time lengths required for preparation of parts other than the motors and the HV 68 according to the job modes, for example, the time lengths required for preparation of laser oscillation of the exposure 18 and for heating of the heating roller 38 of the fuser unit 36. The initial activation time storage section 76 stores initial values of the estimated activation times. The environment storage section 77 stores environmental values when the activation process is performed.

The color printer 1 of this embodiment also includes an environmental sensor 78 and a door sensor 79. Detection results of those sensors are input to the output control section 61. The environmental sensor 78 is used to obtain information of environment (temperature, humidity, etc.) under which the color printer 1 is placed. This detection result of the environmental sensor 78 is stored in the environment storage section 77. The door sensor 79 is used to detect opening and closing of the front door 25 of the color printer 1. For instance, when any of the various units 66 is to be replaced by a user, the door 25 provided in the front of the color printer 1 is opened and closed.

The output control section 61 also performs activation control of the various motors 51 to 58. For instance, in the case where a motor to be activated is a motor which controls its speed by itself, the output control section 61 transmits a signal representing a target set speed to the motor. When the motor reaches the set rotation speed, it outputs a motor lock signal or an encoder pulse signal or the like. At the time when receiving the motor lock signal or the encoder pulse signal or the like, the output control section 61 judges that activation of that motor is completed.

Alternatively, each of the motors 51 to 58 may be a motor for outputting an FG (Frequency Generator) signal of a frequency corresponding to a motor rotation speed. The output control section 61 can grasp the rotation speed at the time when receives the FG signal from each motor. In the case where such motor is used, the output control section 61 outputs a control signal to the motor and receives the FG signal from the motor. The CPU 63 performs feedback control by switching a control signal according to a difference between the target rotation speed and a detected speed obtained from the FG signal transmitted from the motor. By this feedback control, the rotation speed of each motor can be stabilized to a predetermined speed. Alternatively, it may be arranged to receive a motor electric current signal from each motor and, based on the signal, judge completion of activation of each motor.

The controller 62 is connected to an external personal computer 2 or the like to receive a command input. For instance, when a print command is received from the personal computer 2, a print job occurs in the color printer 1. Then, the output control section 61 and the controller 62 transmit and receive various information such as a dot counter value.

The following explanation is given to a method of determining an activation timing of each motor in the color printer 1 of this embodiment. In this color printer 1, for example, when it receives a command to form a monochromatic image, at least the main motor 51, the developing motor 52, and the fuser motor 57 are used. If they are not working, those motors have to be activated before start of image formation and brought into a stable rotating state before respective intended timings. Those motors are DC motors, which are undesirable to be activated at the same time because they require a high-capacity power supply in that case. In this embodiment, therefore, the motors are activated at different timings.

The output control section 61 therefore obtains an image start reference time (a reference time of image formation starting) upon receipt of the image forming command. The image start reference time is determined as a timing to start image formation based on a required time until image data and the others are fully prepared and the image forming process is enabled. This is determined depending on print mode based on the contents stored in the preparation time storage section 75. For example, this is a timing to start the formation of a toner image on the intermediate transfer belt 11.

The output control section 61 grasps one or more motor(s) needed to be activated based on the content of the image forming command and the rotation status of the motors at that time. The motors needed to be rotated for image formation is judged based on the rotation storage section 74 depending on print mode. Of the motors to be rotated, one or more motor(s) that is(are) not working at that time is(are) the motor(s) needed to be activated.

In this embodiment, the time required before the image start reference time is determined uniquely based on a print mode selected by the image forming command. Furthermore, this required time is usually longer than the time required for motor activation and others. Accordingly, when the preparation of image formation and the activation of motors are started at the same time, the preparation of image formation will not be finished even after completion of activation of the motors. In this case, each motor has to continue rotating and wait for the image start reference time. In this embodiment, this wait time is minimized. It is however necessary to ensure that the activation of each motor needed to be activated and the activation of the HV 68 are completed before the image start reference time.

In this embodiment, therefore, the required time until activation of all the motor(s) needed to be activated and the HV 68 is finished is precisely estimated. Accordingly, the color printer 1 includes the activation time storage section 73 in the nonvolatile memory 65. This activation time storage section 73 stores times ("estimated activation time") estimated to be required for each motor and the HV 68 to come into a stable rotating state from activation start. A method of determining this estimated activation time will be mentioned later.

The output control section 61 reads the estimated activation times of all motors judged as needing to be activated from the activation time storage section 73 and also reads the estimated time required for activation of the HV 68. The output control section 61 determines the order of activating the motors and calculate an activation total time by summing the estimated activation times of all the motors to be activated and the HV 68.

Furthermore, the activation start times of the motors and the HV 68 are set so that the end of the total activation period coincides with the image start reference time. Specifically, the activation start time of the motor to be activated first is set to a time going back by the activation total time from the image start reference time. The activation start time of the motor to be activated secondarily is set to a time later by the estimated activation time thereof from the activation start of the first motor. Similarly, the activation start times of all the motors to be activated and the HV 68 are set respectively.

In sync with each activation start time, the output control section 61 transmits an activation start signal to each motor and the HV 68. Upon receipt of the activation start signal, each motor starts to be activated. Each motor controls the speed by itself and, upon completion of activation, outputs a signal representing the activation completion to the output control section 61. Around the time when the estimated activation time of that motor has elapsed, the activation process is almost finished.

In other words, when the estimated activation time of the motor in the previous order ("preceding motor") has elapsed and the motor in the next order ("next motor") starts to be activated, the preceding motor is not supplied with a large amount of electric current even if the activation of the preceding motor is not completely finished. The motor(s) of which the activation is(are) finished is(are) kept in a stable rotating state. Furthermore, as to the HV 68 to be activated after activation of all the motors, the time required for activation thereof can be surely grasped. Accordingly, at the image start reference time, the activation of all the necessary motors and the HV 68 is steadily finished and no unnecessary rotation time of the load members occurs.

Next, a method of determining the estimated activation time will be explained. When power of the color printer 1 is turned on, the estimated activation time of each of the motors and the HV 68 is initialized to an initial value. Specifically, the initial value of the estimated activation time of each motor is read from the initial activation time storage section 76 and stored in the activation time storage section 73. This initial value is a sufficient time with margin to stabilize the rotation speed of the motor within that time even if the motor is activated under any environment and conditions. Before the first image formation after power-on, the activation start time of each motor is determined based on the initial value.

When each motor is to be activated in response to the image forming command, an actual time taken for activation of each motor is obtained. Therefore, the activation timer 71 is started at the same time as the activation start of each motor. Upon receipt of a signal representing the activation completion of the motor, the activation timer 71 is stopped. In this way, the output control section 61 can obtain the actual time taken for activation of each motor.

Unless any particular circumstances occur before the next image formation, the time required for activation of the motor is quite unlikely to largely differ from that during the current activation. In this embodiment, accordingly, the output control section 61 stores, as the estimated activation time of each relevant motor, a value calculated by adding an appropriate margin value ($\alpha$) to the activation time measured by the activation timer 71 during the current activation, in the activation time storage section 73. Every time activation is performed, the output control section 61 measures the activation time of each activated motor, determines the estimated activation time based on the measured value, and updates the stored content in the activation time storage section 73. Herein, this margin value is set to a predetermined value equal to or larger than zero.

The particular circumstances causing a large difference in the time required for motor activation from the preceding activation include, for example, replacement of units and large environmental changes. If a toner bottle is replaced, for instance, the resistance to the rotation of corresponding agitating blade 22 for agitating toner changes largely. When the output control section 61 of this embodiment receives a detection result of the door sensor 79 and determines that the door 25 has been opened and closed, the output control section 61 replaces all the estimated activation times stored in the activation time storage section 73 with the initial values stored in the initial activation time storage section 76.

If the environment is largely different from that during the preceding activation (during measurement of the activation time), the estimated activation times stored in the activation time storage section 73 cannot be used directly. That is, when a detection result of the environmental sensor 78 is largely different from an environmental value stored in the environment storage section 77, the value stored in the activation time storage section 73 is corrected based on environmental change. This is because if the humidity greatly increases or the temperature largely changes, for instance, the toner condition in the developer 17 is likely to change. To update the stored content in the activation time storage section 73, an environmental value at that time is stored in the environment storage section 77.

Figure 3:
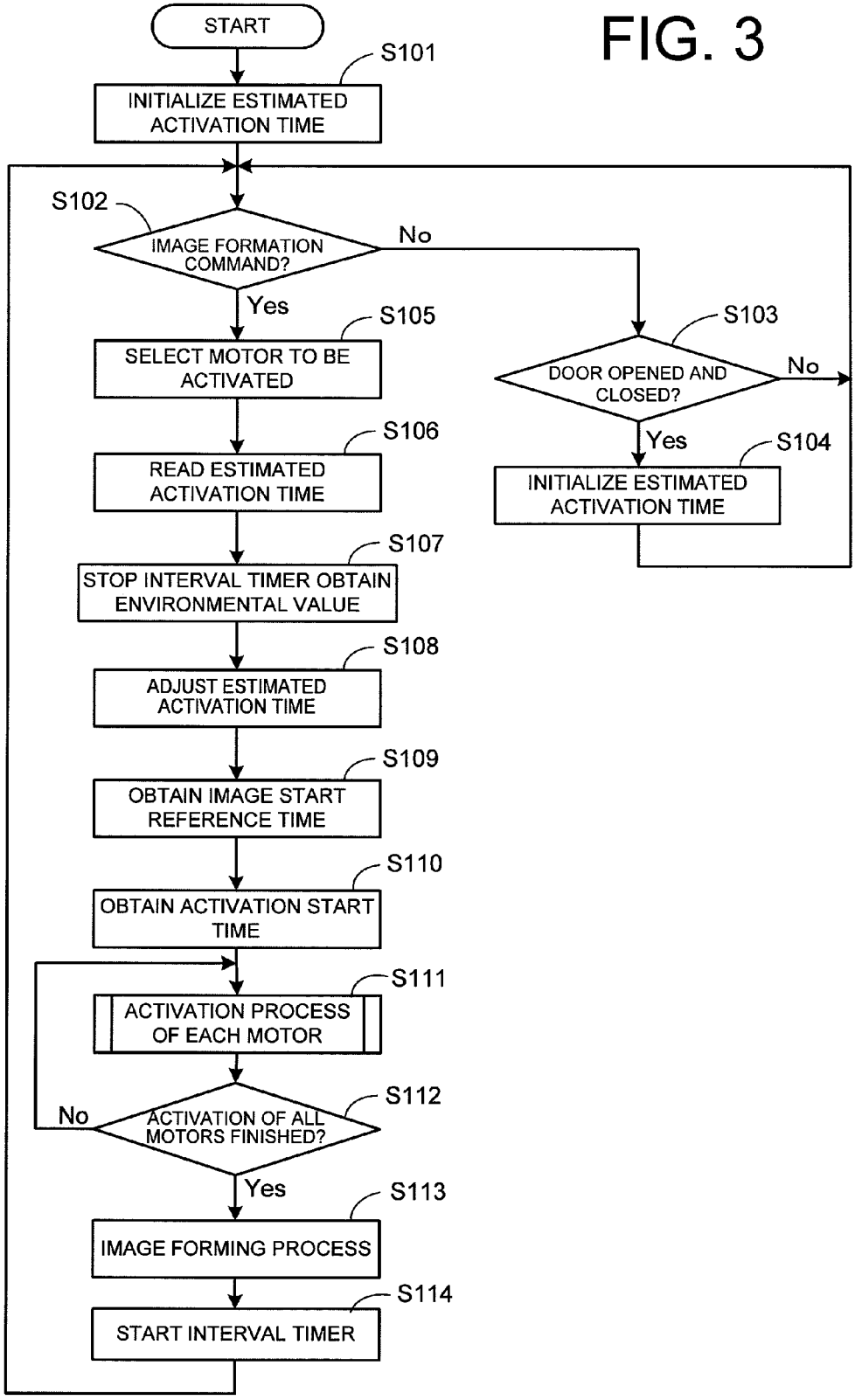
FIG. 3 is a flowchart showing an image forming process.
Figure 4:
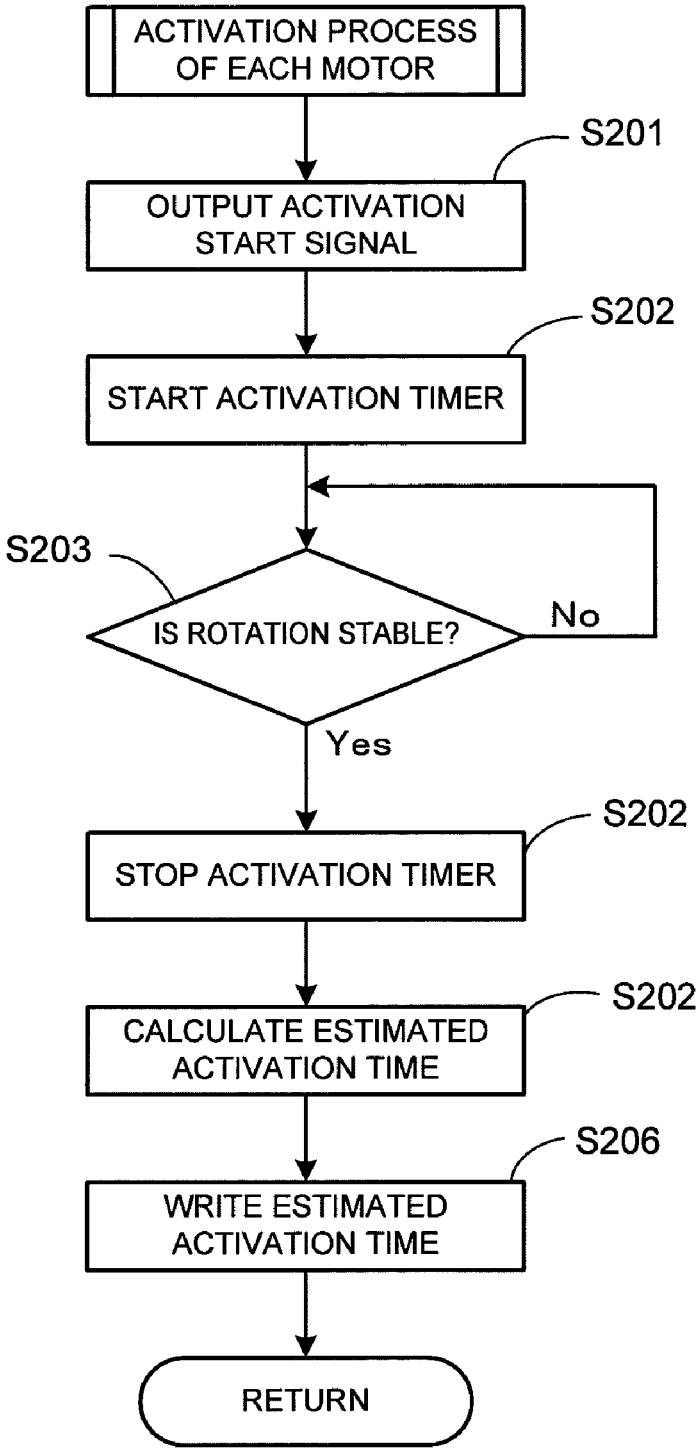
FIG. 4 is a flowchart showing an activation process.

The following explanation is given to an example of the image forming process to be performed by the color printer 1 of this embodiment, referring to the flowcharts of FIGS. 3 and 4. The process shown in FIG. 3 starts to be executed by the output control section 61 upon power-on of the color printer 1. This process continues to run until the power supply is shut off. In this embodiment, upon power-on, the initial value of the estimated activation time of each motor is first read from the initial activation time storage section 76 and set in the activation time storage section 73. Thus, the estimated activation time of each motor is initialized (S101).

It is then determined whether or not the color printer 1 received an image forming command (S102). If no image forming command is received (S102: No), it is determined whether the door 25 is opened and closed or not (S103). If the door 25 is opened and closed (S103: Yes), the estimated activation time is initialized (S104) as in S101.

Checks in S102 and S103 are repeated to wait for an image forming command. If an image forming command is received (S102: Yes), the process advances to S105 and subsequent steps. To be concrete, the output control section 61 selects the motors to be activated this time based on the content in the rotation storage section 74 (S105). Furthermore, the output control section 61 reads the estimated activation time of each selected motor from the activation time storage section 73 (S106), successively stops the interval timer 72 and reads the detection result of the environmental sensor 78 (S107), and adjusts the estimated activation time length based on the result (S108). At that time, the output control section 61 functions as an activation time adding section and an activation time environment correcting section. The adjustment of estimated activation time in S108 will be mentioned later.

According to the job mode, subsequently, the output control section 61 reads a preparation time from the preparation time storage section 75 and obtains an image start reference time based on the result (S109). At this time, the output control section 61 functions as a reference time determining section. This step S109 may be performed anytime before this stage after an affirmative result is obtained in S102. In S110, the activation start time of each motor is obtained based on the image start reference time and the estimated activation time length of each motor adjusted in S108. In other words, the activation start time of each motor is determined by sequentially going back by the estimated activation time length of each motor from the image start reference time.

The output control section 61 starts the activation process at each activation start time obtained for each motor (S111 in FIG. 3). The activation process of each motor is explained later with reference to the flowchart of FIG. 4. At the time of activation start of each motor, the output control section 61 transmits an activation start signal to the relevant motor. Therefore, this step S111 may be executed for several motors simultaneously. Herein, "each motor" also includes the HV 68. The output control section 61 executing this process functions as an activation control section.

It is then determined whether or not activation of all the motors selected in S105 and the HV 68 is finished (S112). If the activation process of all of them is finished (S112: Yes) and the image start reference time comes, the image forming process is started (S113). This step S113 includes all image forming processes for the job of the image forming command received in S102. Unless the image formation condition is changed in the process of the job, the motor rotating status is not changed in one job. The image formation is continuously performed without change.

After the image formation in one job is finished, all the motors are stopped once until a next job is commanded. At that time, the interval timer 72 is started (S114). Then, the process is returned to S102 to wait until an affirmative result is obtained in S102 or S103.

The adjustment of the estimated activation time in S108 is explained below beginning with the interval timer 72 used in S107 and S114. As explained above, the interval timer 72 is started when all the motors are stopped after one job is finished (S114). After receiving the image forming command, the output control section 61 stops and reads the interval timer 72 before adjusting the estimated activation time (S107). In other words, this timer 72 is used to measure an elapsed time from the end of a preceding job to the occurrence of a current job.

If this elapsed time is shorter than a predetermined limit time, it is estimated that the state of relevant motors has not been so changed from that during the preceding motor driving. Thus, the likelihood of the estimated activation time of each motor stored in the activation time storage section 73 is high. However, if a long time has elapsed from the end of the preceding job, the state may be changed from that when the stored estimated activation time was stored.

In this embodiment, therefore, a print interval time from the end of the preceding job is obtained by the interval timer 72 in S107 in FIG. 3. If the print interval time is shorter than the predetermined limit time, each estimated activation time read in S106 is directly used. On the other hand, if the print interval time obtained by the interval timer 72 is longer than the predetermined limit time, each estimated activation time read in S106 is adjusted (S108). For instance, each estimated activation time may be adjusted by adding thereto a predetermined additional time or an additional time determined based on the print interval time.

The adjustment of each estimated activation time based on the results of the environmental sensor 78 in S108 is explained below. The estimated activation time of each motor read from the activation time storage section 73 is a value actually measured under the conditions of the environmental values stored in the environment storage section 77. If the detection result of the environmental sensor 78 is greatly different from the environmental values stored in the environment storage section 77, the likelihood of the estimated activation time of each motor is low. In this case, therefore, each read estimated activation time is subjected to the environment correction based on the environmental value. In this regard, this environment correction may be made in different manners according to whether the environmental change was upward or downward.

The activation process of each motor is explained below with reference to the flowchart of FIG. 4. This process is executed for each motor when the activation start time determined in S110 in FIG. 3 comes. Upon start of this process, the output control section 61 first transmits the activation start signal to the relevant motor (S201) and simultaneously transmits a signal representing a target rotation speed of the motor. The output control section 61 further starts the activation timer 71 (S202).

Upon receipt of the signal output in S201, each motor starts the activation process. When reaches the set rotation speed, each motor transmits a motor lock signal or the like to the output control section 61. Thus, the output control section 61 can grasp that the rotation of the relevant motor has become stable (S203: Yes).

The output control section 61 then stops the activation timer 71 and obtains the time taken for activation of the motor (S204) and further calculates the estimated activation time (S205) by adding the predetermined margin value to the time obtained in S204. The output control section 61 updates the stored content in the activation time storage section 73 based on the calculated estimated activation time (S206). The activation process of each motor is thus finished.

With reference to the time charts of FIGS. 5 and 6, an example of activation timings of the main motor 51 and the color PC motor 53 is explained below. In the case of forming a color image, for example, at least at the start time of a charging process, the main motor 51 and the color PC motor 53 need to be stably rotated and voltage of the HV 68 needs to be stable. The time charts therefore assume the start time of this charging process to be an image start reference time T0 and show timings to activate the main motor 51, the color PC motor 53, and the HV 68. When a job occurs, firstly, the image start reference time T0 is determined based on the content of the job. The timing of job occurrence is the time for example when a print command is input from the personal computer 2 and others or when a print execution button is pressed by a user.

Figure 5:
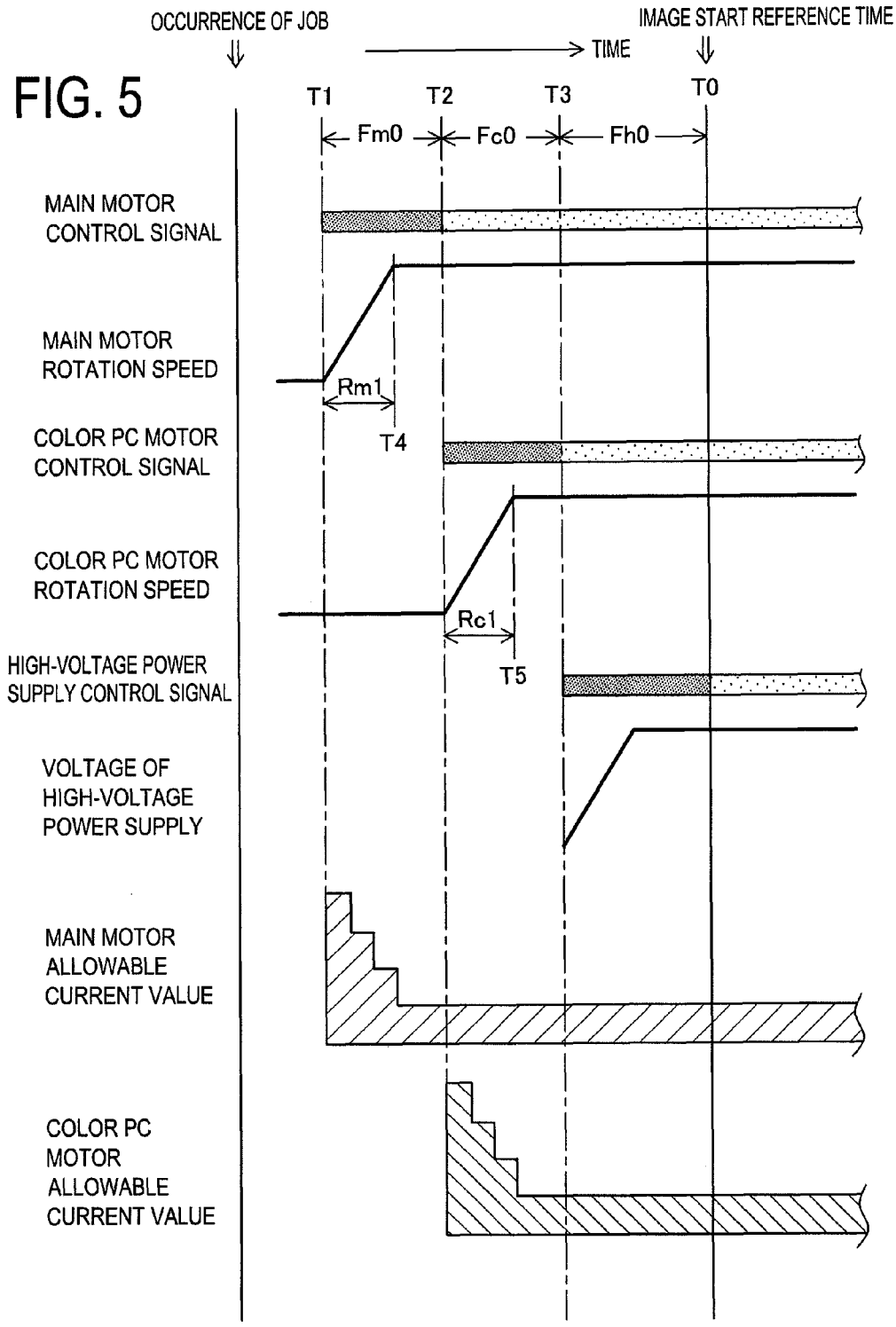
FIG. 5 is a time chart diagram showing an example of activation timings in an initial state.

FIG. 5 shows for example the activation timings in first image formation after power-on. Herein, an initial value of the estimated activation time length of the main motor 51 is assumed to be Fm0 and an initial value of the estimated activation time of the color PC motor 53 is assumed to be Fc0. The activation time of the HV 68 is assumed to be Fh0. In this case, the activation start timing of the main motor 51 is set at time T1 determined by going back by a time length "Fm0+Fc0+Fh0" from the image start reference time T0. The activation start timing of the color PC motor 53 is set at time T2 determined by going back by a time length "Fc0+Fh0" from the image start reference time T0. The activation start timing of the HV 68 is set at time T3 determined by going back by a time length "Fh0" from the image start reference time T0.

When each activation start time comes, the output control section 61 transmits the activation start signals to the relevant one of the main motor 51 and the color PC motor 53. In FIG. 5, a control signal indicating a command to each motor and others is illustrated in divided form of an activation control period (a dark color area) and a fixed speed control period (a faint color area). In this example, the main motor 51 starts to be activated first.

When the rotation speed of the main motor 51 reaches the commanded speed, the main motor 51 outputs the motor lock signal to the output control section 61. This is at time T4 in FIG. 5. From the activation timer 71, an actual activation time Rm1 (=T4−T1) actually taken to activate the main motor 51 is obtained. Using this actual activation time Rm1, an estimated activation time Fm1 of the main motor 51 is calculated by the following equation:

$$Fm1=Rm1+\alpha$$

where $\alpha$ is a predetermined margin value.

Furthermore, the output control section 61 stores this calculated estimated activation time Fm1 of the main motor 51 in the activation time storage section 73. As shown in FIG. 5, if the actual activation time Rm1 is a rather smaller value than the initial value Fm0 of the estimated activation time, Fm1 also becomes a rather smaller value than Fm0. If Fm1 is larger than Fm0, Fm0 may be adopted as the estimated activation time.

Similarly, when the activation time T2 of the color PC motor 53 comes, the activation process of the color PC motor 53 is started. Specifically, the output control section 61 transmits the activation start control signal to the color PC motor 53. As with the case of the main motor 51, the output control section 61 receives the motor lock signal at time T5 and also obtains an actual activation time Rc1 from the activation timer 71. The output control section 61 further calculates the estimated activation time Fc1 by the following expression using the actual activation time Rc1:

$$Fc1=Rc1+\alpha$$

where this $\alpha$ (margin value) may be a different value from that for the case of main motor 51. The output control section 61 stores this calculated estimated activation time Fc1 in the activation time storage section 73.

Subsequently, as shown in FIG. 5, the output control section 61 transmits the activation process control signal to the HV 68 at the activation start timing of the HV 68. For activation of the HV 68, a certain amount of time is needed even after a predetermined voltage is attained. This time is a fixed time determined in advance for each model of color printer 1. Herein, the activation time Fh0 of the HV 68 is a fixed time and not subjected to estimation. When the main motor 51, the color PC motor 53, and the HV 68 are all placed in ready states in the above way, the image forming process is started at image start reference time T0.

Figure 6:
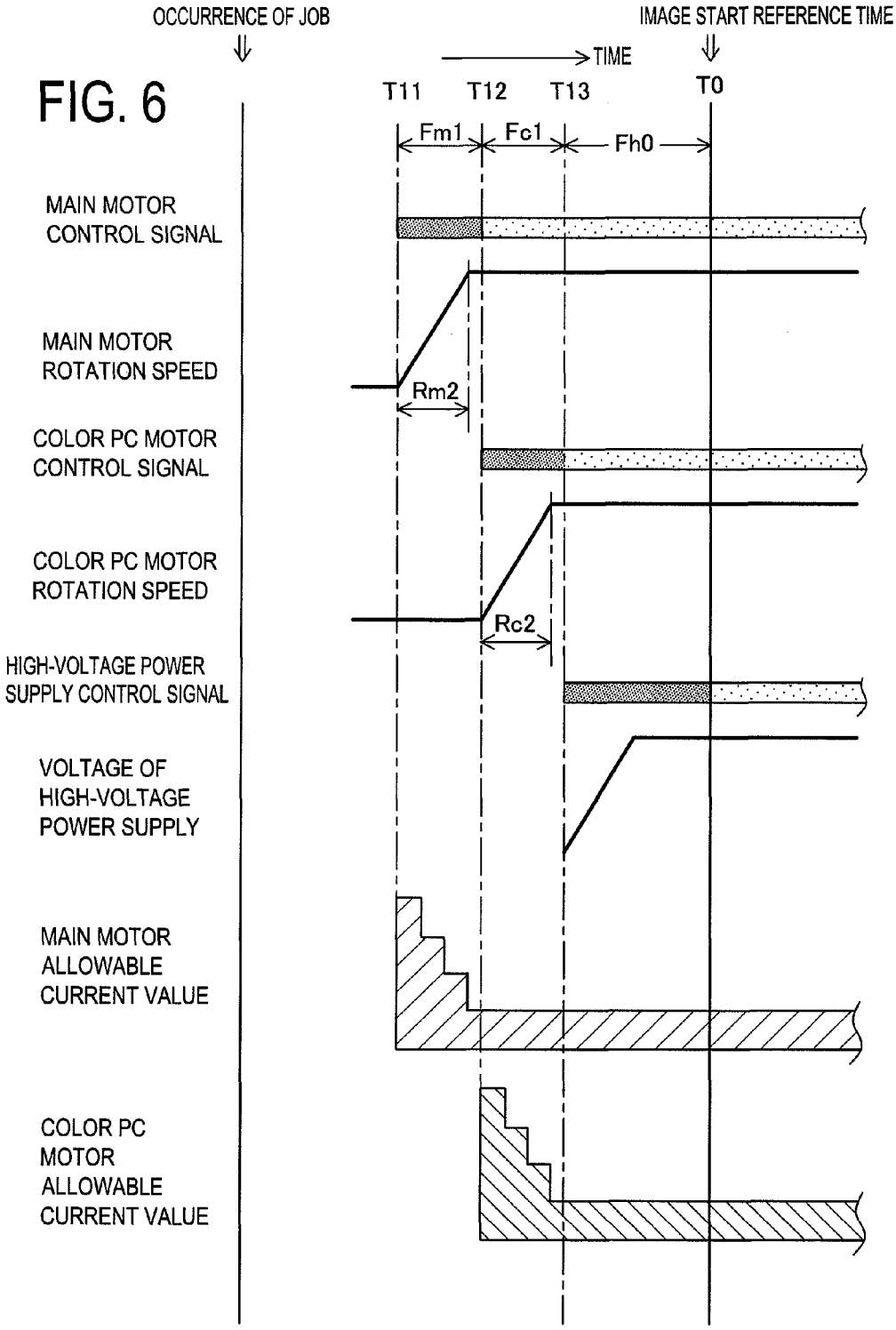
FIG. 6 is a time chart diagram showing an example of activation timings in second and subsequent activations.

FIG. 6 shows the time chart when a next job is commanded. In this job, the estimated activation time of the main motor 51 read from the activation time storage section 73 is Fm1 and the estimated activation time of the color PC motor 53 is Fc1. Accordingly, the activation start timing of the main motor 51 is set at time T11 determined by going back by a time length "Fm1+Fc1+Fh0" from the image start reference time T0. The activation start timing of the color PC motor 53 is set at time T12 determined by going back by a time length "Fc1+Fh0" from the image start reference time T0.

However, if the estimated activation time adjustment in S108 in FIG. 3 is to be conducted, it is performed before time T11 and time T12 are determined. This is the case where the print interval time from the preceding job is longer than the limit time or the case where the value of the environmental sensor 78 is largely different from the preceding environmental value. In those cases, as mentioned above, Fm1 and Fc1 are adjusted to be slightly larger than those read from the activation time storage section 73. Based on the adjusted Fm1 and Fc1, the times 11 and T12 are determined.

Similar to the preceding, the activation process of each motor is conducted. To be concrete, the output control section 61 transmits the activation start signals to the main motor 51 at time T1 and to the color PC motor 53 at time T2 respectively. Actual activation times Rm2 and Rc2 are measured as in the preceding. Based on the newly obtained actual activation times Rm2 and Rc2, a new estimated activation time is calculated and stored in the activation time storage section 73.

As shown in FIG. 6, this time T11 is closer to the image start reference time T0 as compared with the time T1 in FIG. 5. That is, delaying the activation start timings of the motors shortens a wait time before the image formation starts. This is because the preceding actual activation time Rm1 is remarkably shorter than the initial value Fm0. The current estimated activation time Fm1 is determined based on the preceding actual activation time Rm1 and hence the actual activation time Rm2 is unlikely to largely deviate from Fm1.

As above, the estimated activation time of each motor is determined based on a latest actual activation time. Accordingly, unnecessary rotation can be prevented and all the motors that should be activated can be rotated at stable rotation speed determined in advance before the image start reference time.

According to the color printer 1 of this embodiment, as explained in detail above, the estimated activation times are calculated based on the actual results of the motor activation times. The calculated estimated activation times are then stored in the activation time storage section 73. The motors are activated based on those estimated activation times. Thus, it is possible to prevent the motors from rotating more than necessary and to effectively utilize the life of the components to be driven by the motors.

Embodiment 2

Another embodiment of the invention will be explained in detail below with reference to the accompanying drawings. This embodiment is identical in mechanical configuration to the first embodiment excepting a setting method of the estimated activation times.

Figure 7:
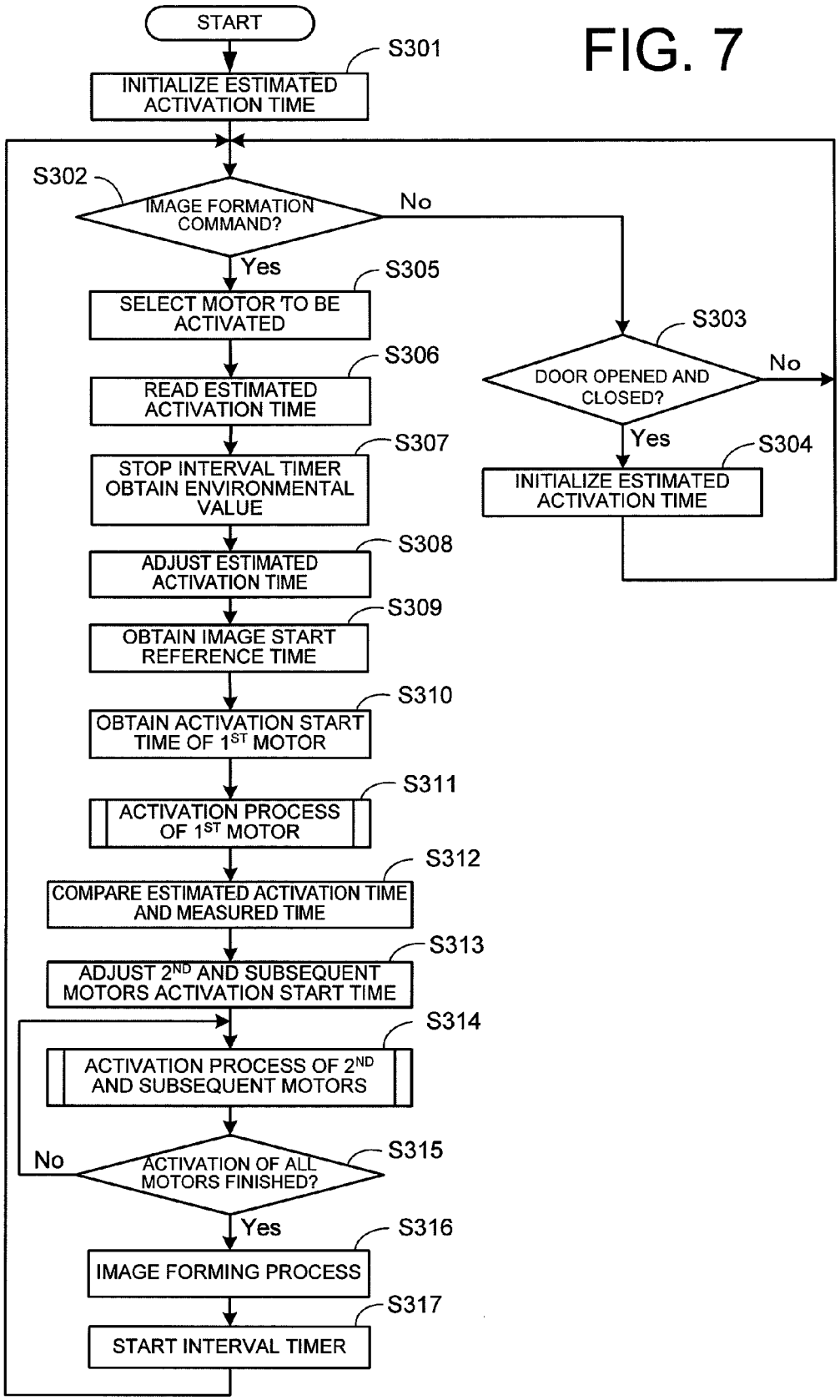
FIG. 7 is a flowchart showing another example of the image forming process.

The image forming process in the color printer of this embodiment is explained below referring to a flowchart of FIG. 7. In this embodiment, similarly, upon power-on, values in the activation time storage section 73 are first initialized (S301). If the door 25 is opened and closed (S303: Yes), those values are also initialized (S304). The flow waits until an image forming command is received (S302: No).

Upon receipt of the image forming command (S302: Yes), the motor(s) to be activated is(are) selected (S305). Subsequently, the estimated activation time(s) of the motor(s) to be activated is(are) read (S306). The interval timer 72 is then stopped and a detection result of the environmental sensor 78 is obtained (S307), thereby the estimated activation time is adjusted (S308). Furthermore, the image start reference time is obtained (S309). The steps so far are the same as those in the first embodiment.

Then, an activation start time of a first motor to be activated first is obtained (S310). The activation start time of the first motor is calculated in the same manner as in the first embodiment by going back by a total time length of the estimated activation times of the motors from the image start reference time. The first motor is subjected to the activation process (S311).

The content of this activation process is the same as in the first embodiment shown in FIG. 4. Specifically, the activation start signal is transmitted to the first motor to activate it and the activation timer 71 detects an actual activation time taken for the activation. A subsequent estimated activation time is calculated from the detected actual activation time and stored in the activation time storage section 73.

In S312, the estimated activation time stored in the activation time storage section 73 before updating and the calculated estimated activation time are compared. Alternatively, the estimated activation time adjusted in S308 and the newly calculated estimated activation time may be compared. From this comparative result, if the newly calculated estimated activation time is judged to be shorter than the other, the estimated activation times of other motors to be subsequently activated are adjusted again for this job. This is because, if the activation time of the motor to be activated first is shorter than estimation, the activation times of other motors are estimated to be shorter, too.

Therefore, according to a ratio between the estimated activation time stored in the activation time storage section 73 and the obtained actual activation time (or the estimated activation time calculated herein), estimated activation times of the second and subsequent motors are recalculated. If the estimated activation times of the second and subsequent motors are recalculated, the activation start times of the second and subsequent motors are adjusted (S313). Herein, they are changed by backward justifying based on the image start reference time obtained in S309. Specifically, the activation start times of the second and subsequent motors are determined by sequentially going back the activation time of the high-voltage power supply and the recalculated estimated activation times of the second and subsequent motors from the image start reference time. This makes it possible to further prevent the motors other than the first motor to be activated from rotating more than necessary.

The preparation time for each component other than the motors from the job occurrence to the image start reference time is determined in each print mode based on the stored content in the preparation time storage section 75. In the above explanation, the preparation time is set to be longer than the time taken to activate the motors. However, for some reasons that, for example, motors to be activated are large in number, there may be a case where the time taken for motor activation is longer and thus the image start reference time is determined based on the time taken for motor activation. In such a case, if the above recalculation results in that the total time taken for motor activation becomes shorter, the image start reference time may be advanced. In other words, with respect to the total time of the estimated activation times of the motors, the activation start time and the image start reference time of each motor may be changed by forward justifying.

In S314, the second and subsequent motors are subjected to the activation process based on the activation start times readjusted in S313. The content of this activation process is the same as in the first embodiment. Furthermore, each motor is activated in order (S314) until the activation of all the motors selected in S305 and the HV 68 is finished (S315: Yes).

When the activation process of all the remaining motors is finished (S315: Yes) and the image start reference time comes, the image forming process is started (S316). After the end of image formation of the job, all the motors are stopped once and the interval timer 72 is started (S317). The process then returns to S302 and waits. Now, the explanation of the image forming process in this embodiment ends.

Figure 8:
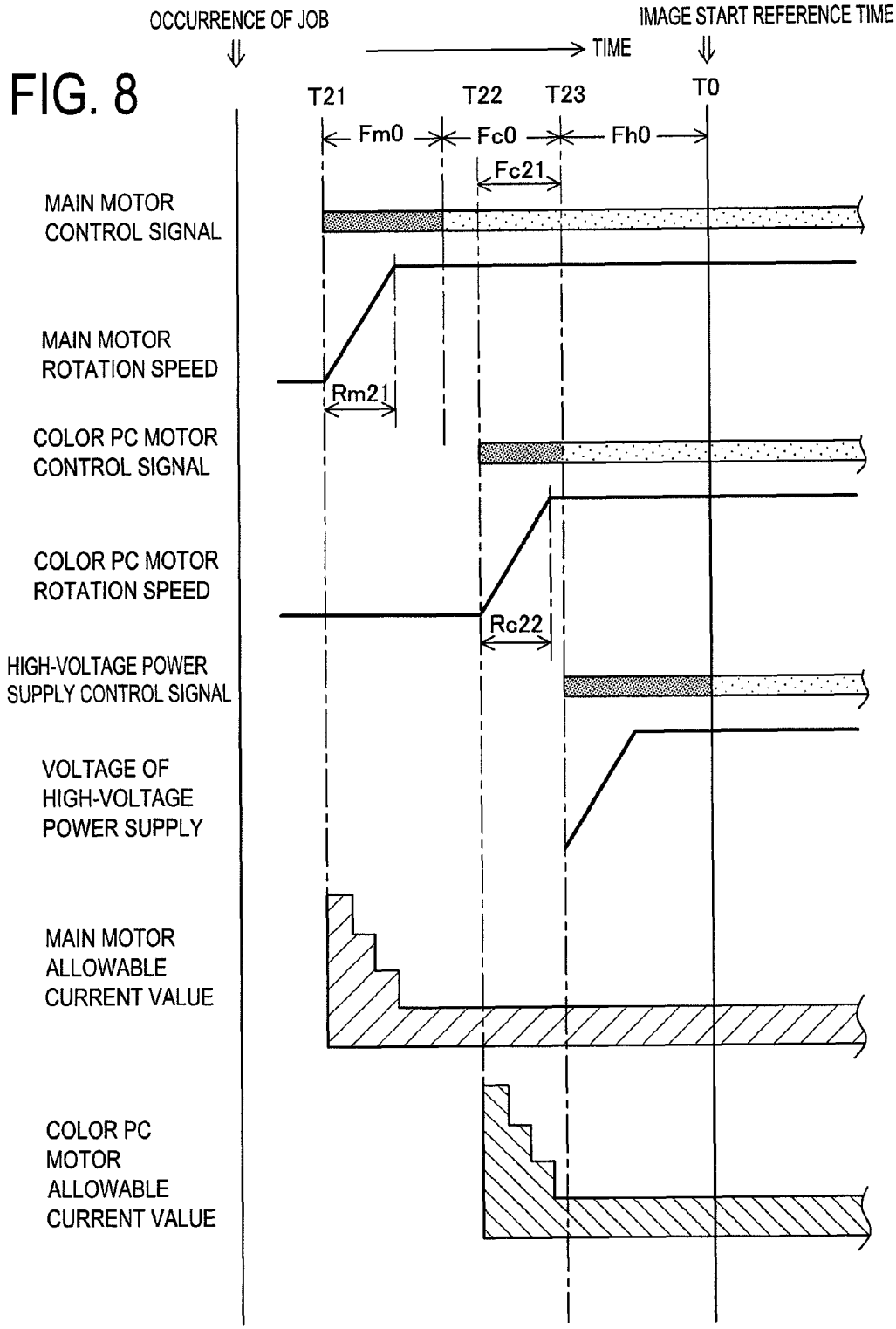
FIG. 8 is a time chart diagram showing an example of activation timings in a second embodiment.
Figure 9:
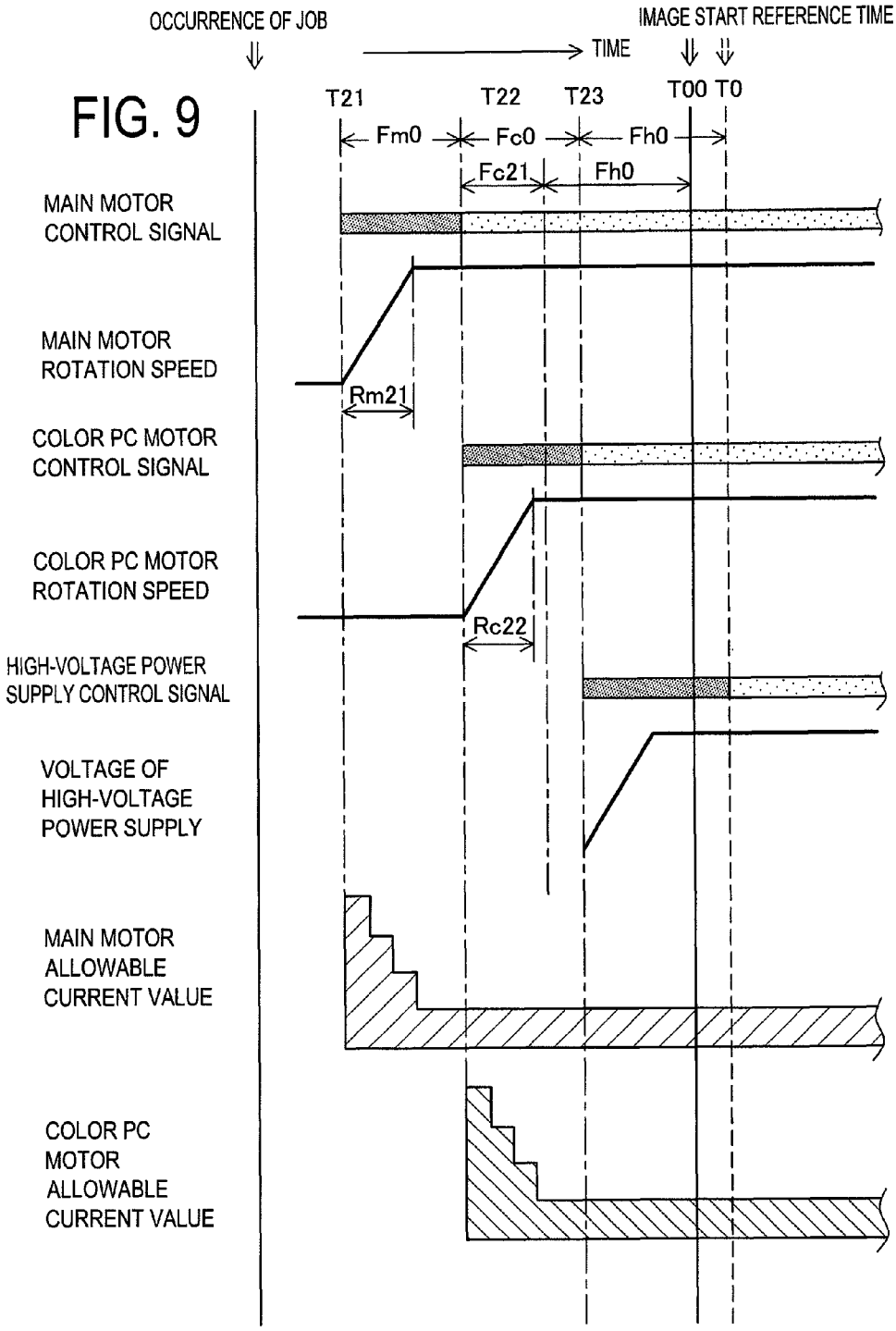
FIG. 9 is a time chart diagram showing another example of activation timings in the second embodiment.

Next, referring to time charts of FIGS. 8 and 9, an example of activation timings of the main motor 51 and the color PC motor 53 from the initial states in this embodiment is explained. Those figures show an example that the activation start times of the color PC motor 53 and the HV 68 are recalculated based on the actual activation time of the main motor 51. An initial value of the estimated activation time of the main motor 51 is assumed to be Fm0, an initial value of the estimated activation time of the color PC motor 53 is assumed to be Fc0, and the activation time of the HV 68 is assumed to be Fh0.

FIG. 8 shows an example where the activation start time of the color PC motor 53 is changed by backward justifying based on the actual activation time of the main motor 51. Specifically, if a total length of the estimated activation times of the motors (herein, Fm0+Fc0+Fh0) is shorter than the preparation time read from the preparation time storage section 75, the process is conducted as shown in this time chart.

The activation start timing of the main motor 51 which is the motor to be activated first is set at time T21 determined by going back by the time length "Fm0+Fc0+Fh0" from the image start reference time T0. Herein, the example of activation from the initial state is shown and therefore this time T21 is the same timing as T1 in FIG. 5.

In this embodiment, as shown in FIG. 8, the main motor 51 starts to be activated at time T21. By the activation timer 71, an actual activation time Rm21 actually taken for activation of the main motor 51 is obtained. In this figure, the obtained actual activation time Rm21 is shorter than the estimated activation time Fm0. Accordingly, the estimated activation times of the second and subsequent motors are recalculated to change the respective activation start times. For instance, based on a ratio between the estimated activation time Fm0 and the actual activation time Rm21 of the main motor 51 and based on the estimated activation time (herein, the initial value Fc0) of the color PC motor 53, the estimated activation time of the color PC motor 53 is recalculated to obtain the estimated activation time Fc21.

In FIG. 8, the activation start timing of the color PC motor 53 is changed to time T22 determined by going back by a time length "Fc21+Fh0" from the image start reference time T0. In this case, the activation start time T23 of the high-voltage power supply remains unchanged. This is the changing by backward justifying. If the actual activation time Rm21 is not shorter than the estimated activation time at that time, no recalculation is performed.

The following explanation is given to an example of the changing by forward justifying with reference to the time chart in FIG. 9. As in the changing by the backward justifying, firstly, the image start reference time T0 and the activation start time T21 of the main motor 51 are set. Herein, however, a total length of the estimated activation times of the motors (herein, Fm0+Fc0+Fh0) is longer than the preparation time read from the preparation time storage section 75.

As in FIG. 8, the main motor 51 starts to be activated at time T21 to obtain the actual activation time Rm21. Since the actual activation time Rm21 is shorter than the estimated activation time Fm0, the estimated activation time of the color PC motor 53 is recalculated to obtain the estimated activation time Fc21. In this case, the color PC motor 53 immediately starts to be activated. The activation start time of a component to be activated next is set to a time delayed by a time Fc21 from the activation start of the color PC motor 53.

As above, the estimated activation times of the motors other than the main motor 51 are recalculated to be shorter so that respective activation start times are put forward, thereby shortening the total time length of the activation times. The image start reference time is also advanced by the shortened length. Thus, the image formation can be started at image start reference time T00 in FIG. 9. This is the changing by forward justifying. In this way, a user's wait time can be further shortened. It is however preferable to justify the activation start times forward within a range of the preparation time.

As above, the color PC motor 53 and each component to be rotated by the motor 53 are prevented from rotating unnecessarily even during first image formation after power-on. Consequently, even the color printer of this embodiment can prevent the motors from rotating more than necessary and effectively utilize the life of each component to be driven by each motor.

The present invention may be embodied in other specific forms without departing from the essential characteristics thereof.

For instance, the actual measurement values and the margin values may be stored separately instead of storing the estimated activation times. The margin values may be set to be different from motor to motor. For example, the above explanation merely shows an example of the position of each motor and the division of roles of the motors. More motors may be provided. Furthermore, any other motors than the DC motor may also be adopted.

Furthermore, in the present invention, preferably, the apparatus further comprises: a print interval measuring section for measuring a print interval time elapsed from the end of a preceding print job to the occurrence of a new print job; and an activation time adding section for adding an additional time to the activation time of each DC motor stored in the activation time storage section when the measured print interval time is longer than a predetermined limit time, and when the additional time is added to the activation time by the activation time adding section, the activation control section determines the activation start time of each DC motor based on the activation time added with the additional time.

The activation times stored in the activation time storage section are based on the actual measurement values in the preceding print job. If the elapsed time from the end of the preceding print job is long, therefore, the state may be changed from the actually measured time. In that case, the motors could not be activated at the stored activation times. In the present invention, the additional time is added to the activation time if the elapsed time is long and thus the activation start time is determined by use of the resultant activation time, thereby making sure the completion of activation. The length of the additional time may be a fixed time determined in advance or may be determined based on the measured elapsed time.

In the present invention, preferably, the apparatus further comprises: an environmental sensor for obtaining an environmental value of temperature or humidity; and an activation time environment correcting section for performing, when a difference between an environmental value obtained at the occurrence of a new print job and an environmental value obtained at a preceding print job is larger than a predetermined limit value, an environment correction of the activation time of each DC motor stored in the activation time storage section based on the difference in environmental value, and when the environment correction is performed by the activation time environment correcting section, the activation control section determines the activation start time of each DC motor based on the activation time after the environment correction.

Loads on some of the components to be driven by the DC motors will be influenced by environments. In the present invention, the activation time is corrected if the environmental value is largely different from that in the preceding actual measurement time. Thus, the activation start time is appropriately selected. The environment correction may be a correction manner different from DC motor to motor.

In the present invention, preferably, the image forming apparatus further comprises: a door for opening and closing a part of an outer surface of the apparatus; an initial activation time storage section for storing an initial value of the activation time of each of the DC motors; a door sensor for detecting an opening and closing operation of the door; and an initializing section for initializing the stored content of the activation time storage section by the stored content of the initial activation time storage section when the opening and closing operation of the door is detected.

If the door is opened and closed, there is a possibility that a replaceable member such as a toner bottle is replaced. In such a case, the activation time of the DC motor related to the replaced member is largely changed. In the present invention, the activation time is initialized when the door is opened and closed. Even if the member is replaced, accordingly, the activation can be reliably conducted. If the apparatus has a means for grasping a member replacement status, only the activation time of the motor related to the replaced member may be initialized.

In the present invention, preferably, the initializing section also performs initialization when power of the apparatus is turned on.

Since the load status of the motor is ungraspable when power of the apparatus is turned on, it is uncertain whether the activation can be started at the stored activation time. In the present invention, the activation time is initialized in such case. Thus, the activation can be reliably conducted. The initial value of the activation time is set to a time at which the activation can be reliably conducted irrespective of the status of each motor.

In the present invention, preferably, the image forming apparatus further comprises: an initial activation time storage section for storing an initial value of the activation time of each of the DC motors; and an initializing section for initializing the stored content of the activation time storage section by the stored content of the initial activation time storage section when power of the apparatus is turned on.

In the present invention, preferably, the actual activation time measuring section measures the actual activation time of the DC motor targeted for measurement based on one of a motor lock signal, an encoder pulse signal, an FG signal, and a motor current signal, the signal being output from the targeted DC motor.

According to the above configuration, it is possible to easily grasp from one of those signals that the DC motor has reached the target rotation speed.

In the present invention, preferably, the apparatus further comprises a high-voltage power supply for supplying high voltage to be used in the image forming section, the activation time storage section also stores an activation time required for activation of the high-voltage power supply, the preparation time stored in the preparation time storage section is a time required for the image forming section excepting the DC motors and the high-voltage power supply to become ready to start image formation, and the activation control section: determines an activation start time of the high-voltage power supply by going back the activation time of the high-voltage power supply stored in the activation time storage section from the image start reference time, determines the activation start time of each of the selected DC motors by sequentially going back the activation times of the selected DC motors stored in the activation time storage section from the activation start time of the high-voltage power supply, and activates one or ones of the DC motors to be activated and the high-voltage power supply according to the determined respective activation start times.

A certain amount of time is required until the output of the high-voltage power supply reaches a set value. It is therefore undesirable to perform activation of the high-voltage power supply and activation of the DC motor at the same time. In the present invention, the time taken to activate the high-voltage power supply is determined by going back from the image start reference time and further the activation start time of each DC motor is determined by going back from the determined activation time of the high-voltage power supply. Accordingly, the activation of all the motors has been finished before the image start reference time. The activating order of the high-voltage power supply does not always have to be last. The activation time of the high-voltage power supply may also be actually measured. Furthermore, the initial activation time storage section preferably stores an initial value of the activation time of the high-voltage power supply.

In the present invention, preferably, the apparatus further comprises: a comparing section for comparing, during activation of the DC motors by the activation control section, a measurement result of the earlier activated DC motor by the actual activation time measuring section with the activation time of that DC motor stored in the activation time storage section; a recalculating section for recalculating, when the comparing section judges that the measurement result is shorter, the activation time of the DC motor to be activated later than the earlier activated DC motor according to a ratio between the stored activation time of the earlier activated DC motor and the measurement result; and a changing section for changing, if the recalculation is conducted, the activation start time of the DC motor to be activated later by backward justifying with respect to the image start reference time according to a result of the recalculation, and the activation control section activates the DC motor of which the activation start time has been changed, according to the changed activation start time.

If a measurement result of the activation time of the DC motor activated earlier is shorter than a stored one, generally, the activation time of the motor to be activated later is also short. In the present invention, therefore, the activation time of the motor to be activated later is recalculated based on a ratio between the activation time of the earlier activated motor and the measurement result. Thus, if the activation time of the motor to be activated later is set to be shorter than a stored one, the activation start time is delayed to shorten the wait time required after completion of activation. For instance, even in a first job after power-on, it is possible to prevent the motor activated later from rotating more than necessary. If the recalculation is conducted, the activation time of the high-voltage power supply may also be recalculated in the same manner.

In the present invention, preferably, the reference time determining section determines the image start reference time based on a longer one between the preparation time stored in the preparation time storage section and a total of the activation times of the DC motors to be newly activated stored in the activation time storage section, the changing section changes the activation start time of the DC motor to be activated later by backward justifying only in the case the image start reference time is determined based on the preparation time stored in the preparation time storage section, and the changing section changes the activation start time of the DC motor to be activated later and the image start reference time by forward justifying with respect to the activation completion time of the DC motor earlier activated in the case the image start reference time is determined based on the total of the activation times of the DC motors.

If the total of the activation times of the DC motors is longer than the preparation time of parts other than the DC motors, the image start reference time is preferably determined based on the total of the longer activation times of the motors. In this case, the image start reference time can be moved forward if the total of the activation times of the motors is changed to be shorter. In the present invention, in such a case, the activation start time of each DC motor and the image start reference time are changed by forward justifying by the changing section, so that a user's wait time can be shortened.

REFERENCE SIGNS LIST

1: Color printer
10Y, 10M, 10C, 10K: Image cartridge
25: Door
51 to 58: Motor
61: Output control section
68: High voltage power supply
71: Activation timer
72: Interval timer
73: Activation time storage section
74: Rotation storage section
75: Preparation time storage section

76: Initial activation time storage section
77: Environment storage section
78: Environment sensor
79: Door sensor

The invention claimed is:

1. An image forming apparatus comprising: an image forming section including a plurality of rotary bodies to form an image by rotation of the rotary bodies; a plurality of DC motors for driving each part of the image forming section; and a drive control section for controlling the DC motors, each of the DC motors being adapted to drive at least one of the rotary bodies, wherein the apparatus comprises:

an activation time storage section for storing an activation time required for each of the DC motors to reach a target speed from activation start thereof;

a rotation storage section for storing information about ones of the DC motors, the ones being needed to be rotated in each print mode;

a preparation time storage section for storing a preparation time required for a part of the image forming section excepting the DC motors to become ready to start image formation in each print mode;

a reference time determining section for determining, when a print job occurs, an image start reference time based on the preparation time stored in the preparation time storage section according to a print mode of the print job, an activation control section for:

when a print job occurs, selecting one or ones of the DC motors, the one or ones being needed to be newly activated, according to a print mode of the print job based on a current rotating status of each of the DC motors and a stored content of the rotation storage section;

determining an activation start time of each of the selected DC motors by sequentially going back, from the image start reference time, by activation times of the selected DC motors stored in the activation time storage section; and;

activating one or ones of the selected DC motors to be activated, at each determined activation start time;

an actual activation time measuring section for measuring an actual activation time of each of the DC motors to be activated by the activation control section;

an activation time updating section for updating the stored content of the activation time storage section based on a measurement result of the actual activation time measuring section, the activation control section being adapted to determine an activation start time of each of the DC motors based on the activation time updated by the activation time updating section for a next print job;

a door for opening and closing a part of an outer surface of the apparatus;

an initial activation time storage section for storing an initial value of the activation time of each of the DC motors;

a door sensor for detecting an opening and closing operation of the door; and an initializing section for initializing the stored content of the activation time storage section by the stored content of the initial activation time storage section when the opening and closing operation of the door is detected.

2. The image forming apparatus according to claim 1, wherein the apparatus further comprises:

a print interval measuring section for measuring a print interval time elapsed from the end of a preceding print job to the occurrence of a new print job; and an activation time adding section for adding an additional time to the activation time of each DC motor stored in the activation time storage section when the measured print interval time is longer than a predetermined limit time, and when the additional time is added to the activation time by the activation time adding section, the activation control section determines the activation start time of each DC motor based on the activation time added with the additional time.

3. The image forming apparatus according to claim 1, wherein the apparatus further comprises:

an environmental sensor for obtaining an environmental value of temperature or humidity; and an activation time environment correcting section for performing, when a difference between an environmental value obtained at the occurrence of a new print job and an environmental value obtained at a preceding print job is larger than a predetermined limit value, an environment correction of the activation time of each DC motor stored in the activation time storage section based on the difference in environmental value, and when the environment correction is performed by the activation time environment correcting section, the activation control section determines the activation start time of each DC motor based on the activation time after the environment correction.

4. The image forming apparatus according to claim 2, wherein the apparatus further comprises:

an environmental sensor for obtaining an environmental value of temperature or humidity; and an activation time environment correcting section for performing, when a difference between an environmental value obtained at the occurrence of a new print job and an environmental value obtained at a preceding print job is larger than a predetermined limit value, an environment correction of the activation time of each DC motor stored in the activation time storage section based on the difference in environmental value, and when the environment correction is performed by the activation time environment correcting section, the activation control section determines the activation start time of each DC motor based on the activation time after the environment correction.

5. The image forming apparatus according to claim 1, wherein the initializing section also performs initialization when power of the apparatus is turned on.

6. The image forming apparatus according to claim 2, wherein the initializing section also performs initialization when power of the apparatus is turned on.

7. The image forming apparatus according to claim 3, wherein the initializing section also performs initialization when power of the apparatus is turned on.

8. The image formation apparatus according to claim 4, wherein the initializing section also performs initialization when power of the apparatus is turned on.

9. An image forming apparatus comprising: an image forming section including a plurality of rotary bodies to form an image by rotation of the rotary bodies; a plurality of DC motors for driving each part of the image forming section; and a drive control section for controlling the DC motors, each of the DC motors being adapted to drive at least one of the rotary bodies, wherein the apparatus comprises:

an activation time storage section for storing an activation time required for each of the DC motors to reach a target speed from activation start thereof;

a rotation storage section for storing information about ones of the DC motors, the ones being needed to be rotated in each print mode;

a preparation time storage section for storing a preparation time required for a part of the image forming section excepting the DC motors to become ready to start image formation in each print mode;

a reference time determining section for determining, when a print job occurs, an image start reference time based on the preparation time stored in the preparation time storage section according to a print mode of the print job, an activation control section for:

when a print job occurs, selecting one or ones of the DC motors, the one or ones being needed to be newly activated, according to a print mode of the print job based on a current rotating status of each of the DC motors and a stored content of the rotation storage section;

determining an activation start time of each of the selected DC motors by sequentially going back, from the image start reference time, by activation times of the selected DC motors stored in the activation time storage section; and;

activating one or ones of the selected DC motors to be activated, at each determined activation start time;

an actual activation time measuring section for measuring an actual activation time of each of the DC motors to be activated by the activation control section;

an activation time updating section for updating the stored content of the activation time storage section based on a measurement result of the actual activation time measuring section, the activation control section being adapted to determine an activation start time of each of the DC motors based on the activation time updated by the activation time updating section for a next print job;

an initial activation time storage section for storing an initial value of the activation time of each of the DC motors; and an initializing section for initializing the stored content of the activation time storage section by the stored content of the initial activation time storage section when power of the apparatus is turned on.

10. The image forming apparatus according to claim 1, wherein the actual activation time measuring section measures the actual activation time of the DC motor targeted for measurement based on one of a motor lock signal, an encoder pulse signal, an FG signal, and a motor current signal, the signal being output from the targeted DC motor.

11. An image forming apparatus comprising: an image forming section including a plurality of rotary bodies to form an image by rotation of the rotary bodies; a plurality of DC motors for driving each part of the image forming section; and a drive control section for controlling the DC motors, each of the DC motors being adapted to drive at least one of the rotary bodies, wherein the apparatus comprises:

an activation time storage section for storing an activation time required for each of the DC motors to reach a target speed from activation start thereof;

a rotation storage section for storing information about ones of the DC motors, the ones being needed to be rotated in each print mode;

a preparation time storage section for storing a preparation time required for a part of the image forming section excepting the DC motors to become ready to start image formation in each print mode;

a reference time determining section for determining, when a print job occurs, an image start reference time based on the preparation time stored in the preparation time storage section according to a print mode of the print job, an activation control section for:

when a print job occurs, selecting one or ones of the DC motors, the one or ones being needed to be newly activated, according to a print mode of the print job based on a current rotating status of each of the DC motors and a stored content of the rotation storage section;

determining an activation start time of each of the selected DC motors by sequentially going back, from the image start reference time, by activation times of the selected DC motors stored in the activation time storage section; and;

activating one or ones of the selected DC motors to be activated, at each determined activation start time;

an actual activation time measuring section for measuring an actual activation time of each of the DC motors to be activated by the activation control section;

an activation time updating section for updating the stored content of the activation time storage section based on a measurement result of the actual activation time measuring section, the activation control section being adapted to determine an activation start time of each of the DC motors based on the activation time updated by the activation time updating section for a next print job;

a high-voltage power supply for supplying high voltage to be used in the image forming section, wherein the activation time storage section also stores an activation time required for activation of the high-voltage power supply, the preparation time stored in the preparation time storage section is a time required for the image forming section excepting the DC motors and the high-voltage power supply to become ready to start image formation, and the activation control section:

determines an activation start time of the high-voltage power supply by going back the activation time of the high-voltage power supply stored in the activation time storage section from the image start reference time, determines the activation start time of each of the selected DC motors by sequentially going back the activation times of the selected DC motors stored in the activation time storage section from the activation start time of the high-voltage power supply, and activates one or ones of the DC motors to be activated and the high-voltage power supply according to the determined respective activation start times.

12. An image forming apparatus comprising: an image forming section including a plurality of rotary bodies to form an image by rotation of the rotary bodies; a plurality of DC motors for driving each part of the image forming section; and a drive control section for controlling the DC motors, each of the DC motors being adapted to drive at least one of the rotary bodies, wherein the apparatus comprises:

an activation time storage section for storing an activation time required for each of the DC motors to reach a target speed from activation start thereof;

a rotation storage section for storing information about ones of the DC motors, the ones being needed to be rotated in each print mode;

a preparation time storage section for storing a preparation time required for a part of the image forming section excepting the DC motors to become ready to start image formation in each print mode;

a reference time determining section for determining, when a print job occurs, an image start reference time based on the preparation time stored in the preparation time storage section according to a print mode of the print job, an activation control section for:

when a print job occurs, selecting one or ones of the DC motors, the one or ones being needed to be newly activated, according to a print mode of the print job based on a current rotating status of each of the DC motors and a stored content of the rotation storage section;

determining an activation start time of each of the selected DC motors by sequentially going back, from the image start reference time, by activation times of the selected DC motors stored in the activation time storage section; and;

activating one or ones of the selected DC motors to be activated, at each determined activation start time;

an actual activation time measuring section for measuring an actual activation time of each of the DC motors to be activated by the activation control section;

an activation time updating section for updating the stored content of the activation time storage section based on a measurement result of the actual activation time measuring section, the activation control section being adapted to determine an activation start time of each of the DC motors based on the activation time updated by the activation time updating section for a next print job;

a comparing section for comparing, during activation of the DC motors by the activation control section, a measurement result of an actual activation time of the activated DC motor by the actual activation time measuring section with the activation time of that DC motor stored in the activation time storage section;

a recalculating section for recalculating, when the comparing section judges that the measurement result is shorter than the stored activation time, the activation time of one or ones of the DC motors which is activated later than the activated DC motor according to a ratio between the stored activation time of the activated DC motor and the measurement result; and a changing section for changing, if the recalculation is conducted, the activation start time of the one or ones of the DC motors to move toward the image start reference time according to a result of the recalculation, and the activation control section activates the DC motor of which the activation start time has been changed, according to the changed activation start time.

13. The image forming apparatus according to claim 12, wherein the reference time determining section determines the image start reference time based on a longer one between the preparation time stored in the preparation time storage section and a total of the activation times of the DC motors to be newly activated stored in the activation time storage section, the changing section changes the activation start time of the DC motor to be activated later by backward justifying only in the case the image start reference time is determined based on the preparation time stored in the preparation time storage section, and the changing section changes the activation start time of the DC motor to be activated later and the image start reference time by forward justifying with respect to the activation completion time of the DC motor earlier activated in the case the image start reference time is determined based on the total of the activation times of the DC motors.

14. The image forming apparatus according to claim 9, wherein the apparatus further comprises:

a print interval measuring section for measuring a print interval time elapsed from the end of a preceding print job to the occurrence of a new print job; and an activation time adding section for adding an additional time to the activation time of each DC motor stored in the activation time storage section when the measured print interval time is longer than a predetermined limit time, and when the additional time is added to the activation time by the activation time adding section, the activation control section determines the activation start time of each DC motor based on the activation time added with the additional time.

15. The image forming apparatus according to claim 9, wherein the apparatus further comprises:

an environmental sensor for obtaining an environmental value of temperature or humidity; and an activation time environment correcting section for performing, when a difference between an environmental value obtained at the occurrence of a new print job and an environmental value obtained at a preceding print job is larger than a predetermined limit value, an environment correction of the activation time of each DC motor stored in the activation time storage section based on the difference in environmental value, and when the environment correction is performed by the activation time environment correcting section, the activation control section determines the activation start time of each DC motor based on the activation time after the environment correction.

16. The image forming apparatus according to claim 14, wherein the apparatus further comprises:

an environmental sensor for obtaining an environmental value of temperature or humidity; and an activation time environment correcting section for performing, when a difference between an environmental value obtained at the occurrence of a new print job and an environmental value obtained at a preceding print job is larger than a predetermined limit value, an environment correction of the activation time of each DC motor stored in the activation time storage section based on the difference in environmental value, and when the environment correction is performed by the activation time environment correcting section, the activation control section determines the activation start time of each DC motor based on the activation time after the environment correction.

17. The image forming apparatus of claim 1, further comprising:

a comparing section for comparing, during activation of the DC motors by the activation control section, a measurement result of the activated DC motor by the actual activation time measuring section with the activation time of that DC motor stored in the activation time storage section;

a recalculating section for recalculating, when the comparing section judges that the measurement result is shorter than the stored activation time, the activation time of one or ones of the DC motors which is activated later than the activated DC motor according to a ratio between the stored activation time of the activated DC motor and the measurement result; and a changing section for changing, if the recalculation is conducted, the activation start time of the one or ones of the DC motors to move toward the image start reference time according to a result of the recalculation, and the activation control section activates the DC motor of which the activation start time has been changed, according to the changed activation start time.

18. The image forming apparatus of claim 9, further comprising:

a comparing section for comparing, during activation of the DC motors by the activation control section, a measurement result of the activated DC motor by the actual activation time measuring section with the activation time of that DC motor stored in the activation time storage section;

a recalculating section for recalculating, when the comparing section judges that the measurement result is shorter than the stored activation time, the activation time of one or ones of the DC motors which is activated later than the activated DC motor according to a ratio between the stored activation time of the activated DC motor and the measurement result; and a changing section for changing, if the recalculation is conducted, the activation start time of the one or ones of the DC motors to move toward the image start reference time according to a result of the recalculation, and the activation control section activates the DC motor of which the activation start time has been changed, according to the changed activation start time.

19. The image forming apparatus of claim 11, further comprising:

a comparing section for comparing, during activation of the DC motors by the activation control section, a measurement result of the activated DC motor by the actual activation time measuring section with the activation time of that DC motor stored in the activation time storage section;

a recalculating section for recalculating, when the comparing section judges that the measurement result is shorter than the stored activation time, the activation time of one or ones of the DC motors which is activated later than the activated DC motor according to a ratio between the stored activation time of the activated DC motor and the measurement result; and a changing section for changing, if the recalculation is conducted, the activation start time of the one or ones of the DC motors to move toward the image start reference time according to a result of the recalculation, and the activation control section activates the DC motor of which the activation start time has been changed, according to the changed activation start time.

* * * * *